United States Patent [19]

Rosenthal

[11] Patent Number: 4,898,239

[45] Date of Patent: Feb. 6, 1990

[54] RETRIEVABLE BRIDGE PLUG

[75] Inventor: Wayne O. Rosenthal, Fort Worth, Tex.

[73] Assignee: Teledyne Industries, Inc., Los Angeles, Calif.

[21] Appl. No.: 314,388

[22] Filed: Feb. 23, 1989

[51] Int. Cl.[4] ..... E21B 33/129

[52] U.S. Cl. ..... 166/133; 166/135; 166/188; 166/194

[58] Field of Search ..... 166/373, 387, 126, 128, 166/131, 133, 135, 150, 152, 181, 182, 184, 188, 192, 194

[56] References Cited

U.S. PATENT DOCUMENTS

| | | | |
|---|---|---|---|
| 3,314,480 | 4/1967 | Scott | 166/133 |
| 3,461,959 | 8/1969 | Conrad | 166/133 |
| 3,509,940 | 5/1970 | Young | 166/133 |
| 4,149,594 | 4/1979 | Evans | 166/133 |
| 4,432,418 | 2/1984 | Mayland | 166/135 |
| 4,436,150 | 3/1984 | Barker | 166/135 |
| 4,586,567 | 5/1986 | Jameson | 166/133 |
| 4,646,829 | 3/1987 | Barrington et al. | 166/135 |

*Primary Examiner*—Bruce M. Kisliuk

*Attorney, Agent, or Firm*—Arthur F. Zobal; Geoff Mantooth

[57] ABSTRACT

A retrievable bridge plug apparatus has slip segments and packing elements which are extendable to outward positions. In a cased well, the slip segments grip the casing and prevent the longitudinal movement of the bridge plug. The packing elements contact the casing to provide a seal to isolate the well interval above the bridge plug from the well interval below the bridge plug. The bridge plug is retrieved from the well by equalizing pressure and then retracting the slip segments and packing elements. Pressure is equalized by pulling up on the retrieving tool, which couples to a fishing neck at the upper end of the bridge plug. Pulling up on the fishing neck opens a valve and exposes a flow path for fluid. The slip segments, and consequently the packing elements, are prevented from retracting during the equalization of pressure by a locking device. Then, the retrieving tool is set down to lower the fishing neck. Lowering the fishing neck releases the locking device. The retrieving tool is pulled up on again to retract the slip segments and the packing elements. By using separate and opposite manipulative motions to equalize pressure and retract the slip segments, control of the bridge plug is maintained during pressure equalization.

3 Claims, 7 Drawing Sheets

RETRIEVABLE BRIDGE PLUG

FIELD OF THE INVENTION

The present invention relates to retrievable bridge plugs for oil and gas well casing, such as are used in wireline workover operations.

BACKGROUND OF THE INVENTION

Bridge plugs are tools that are lowered into a cased oil or gas well. When set in position inside of the casing, a bridge plug provides a seal to isolate pressure between two zones or intervals in the well. Bridge plugs are useful during workover operations when, for whatever reason, a seal is required downhole to isolate two zones. An example of such a situation occurs during workover operations on an upper zone, where the lower zone generates high pressure. The bridge plug acts as a stop to prevent the leakage of fluid from the lower zone into the upper interval of the well.

Retrievable bridge plugs are used during workover operations when a temporary separation of zones is required. A permanent type of bridge plug could be used; however, this type of bridge plug is removed by drilling out, which is a costly and time consuming procedure.

A retrievable bridge plug has slip elements and packer elements. The slip elements are used to grip the inside surface of the well casing, thereby preventing the bridge plug from moving up or down the casing. The packer elements engage the inside surface of the well casing to provide the requisite seal. The bridge plug is set in position by radially extending the slip elements and the packer elements. To retrieve the bridge plug from the well casing, the slip elements and packer elements are retracted and disengaged from the casing inside surface.

During workover operations, a pressure differential above and below the bridge plug may be developed. It is desirable to equalize this pressure differential before the slip and packer elements are disengaged. Equalization prevents the loss of control over the bridge plug, wherein the tool may be blown up or down a well casing in response to the pressure differential, after the slip and packer elements have been released.

In prior art bridge plugs, the tool is released by manipulations that are also used to equalize pressure. For example, in Mayland, U.S. Pat. No. 4,432,418, pressure is equalized by pulling up on the tool. Continued upward force causes the slip and packer elements to release. The bridge plug thus can be released while still under a pressure differential. What is needed is a bridge plug that can be manipulated to equalize pressure without the possibility of releasing the slip and packer elements.

SUMMARY OF THE INVENTION

It is an object of the present invention to provide a retrievable bridge plug apparatus that can be manipulated to equalize a pressure differential existing across the bridge plug, minimizing the possibility of releasing the slip and packer elements.

It is a further object of the present invention to provide a retrievable bridge plug apparatus that can be retrieved from a set position inside of well casing by pulling up on portions of the bridge plug apparatus to equalize pressure, setting down to uncover and allow the release of a locking device that prevents retraction of the slip segments and packing elements, and then pulling up once again to retract the slip segments and packing elements.

It is another object of the present invention to provide a bridge plug apparatus that can be manipulated through five positions for setting and retrieving the apparatus.

In using and running the bridge plug apparatus in and out of the borehole, the bridge plug is manipulated through five positions. In the first or running position, the gripping means, or slip segments, and the packing means are retracted, allowing the bridge plug to be lowered downhole. In the second or set position, the bridge plug is set and the gripping means and the packing means are extended to engage the casing. The gripping means grip the casing to prevent longitudinal movement of the bridge plug up or down the well casing. The packing means contact the inside surface of the casing to provide a seal between the bridge plug and the casing. In the third position, the bridge plug is readied for retrieval by opening a valve to equalize pressure above and below the bridge plug. Upward force is used to open the valve. The gripping means and the packing means remain extended to engage the casing. In the fourth position, locking segments within the bridge plug that prevent the retraction of the gripping means and packing means are released. The locking segments are released as a prerequisite to retracting the gripping means and the packing means. Downward force is used to release the locking segments. In the fifth position, the gripping means and packing means are retracted by the use of upward force. The bridge plug can then be pulled up out of the borehole.

BACKGROUND OF THE INVENTION

Figure 3A:
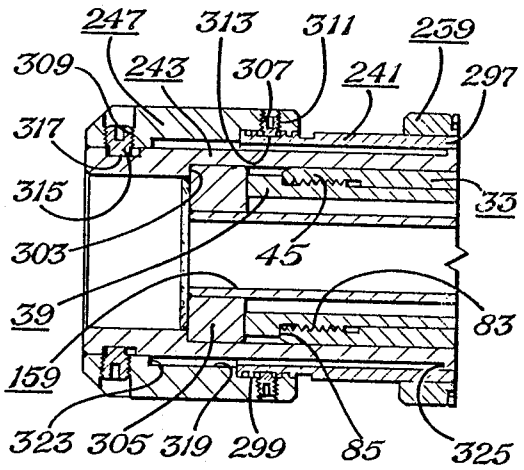
Figure 3B:
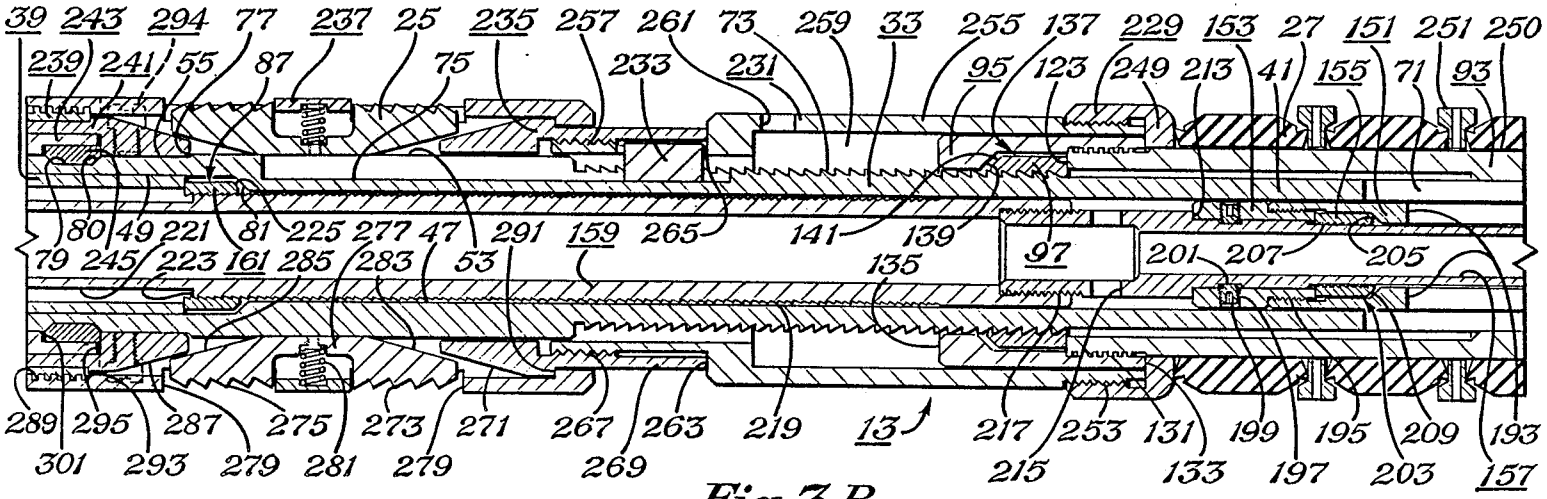
Figure 3C:
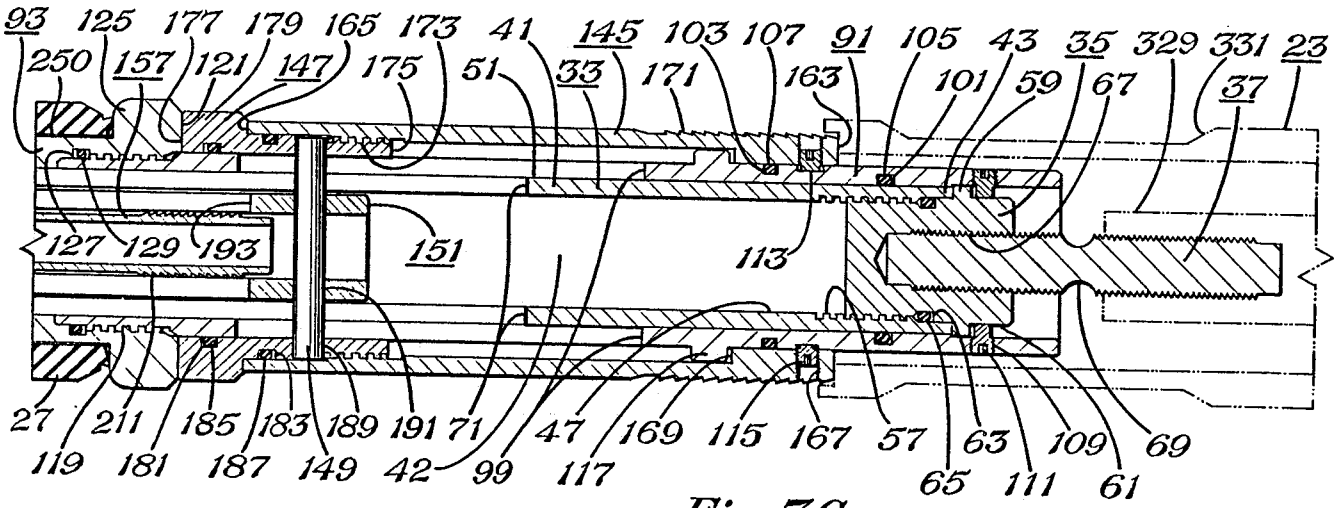

FIGS. 3A, 3B, and 3C are longitudinal cross-sectional views of the bridge plug in a first or running position. FIG. 3A shows the lower end portion of the bridge plug, FIG. 3B shows the central portion, and FIG. 3C shows the upper end portion.

Figure 4A:
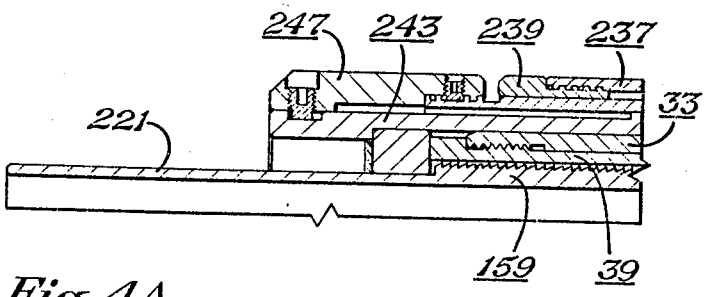
Figure 4B:
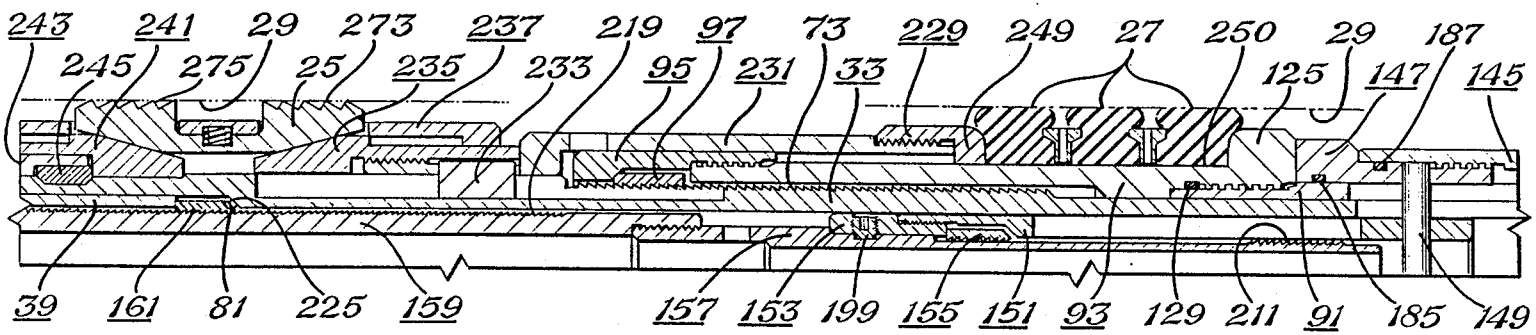
Figure 4C:
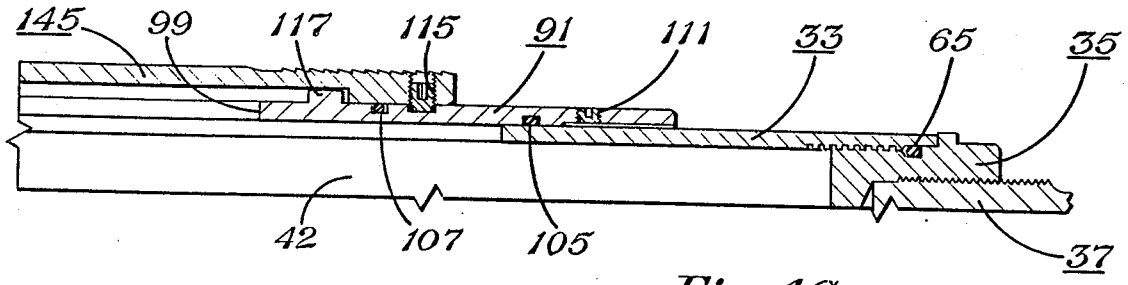

FIGS. 4A, 4B, and 4C are longitudinal cross-sectional views of the bridge plug in a second or set position.

Figure 5A:
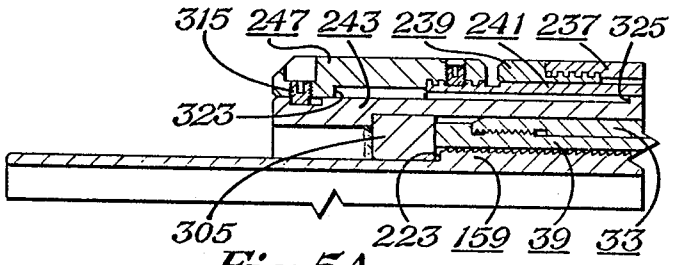
Figure 5B:
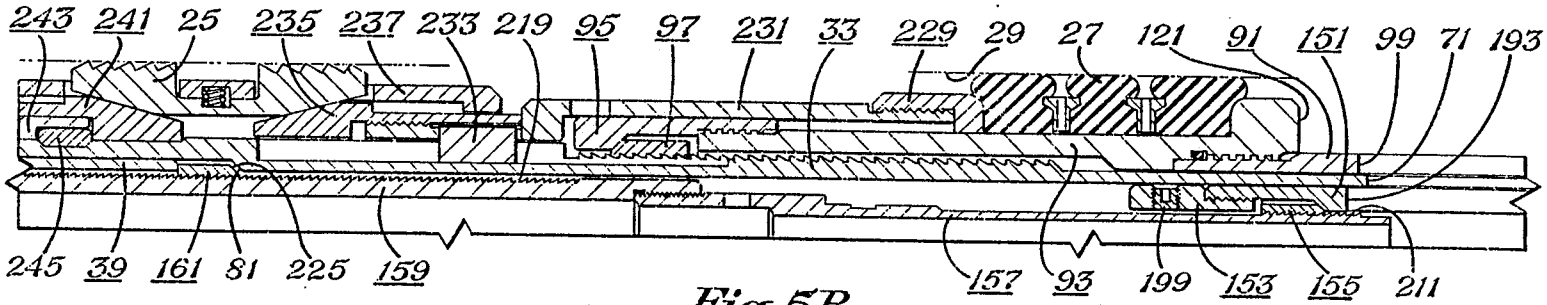
Figure 5C:
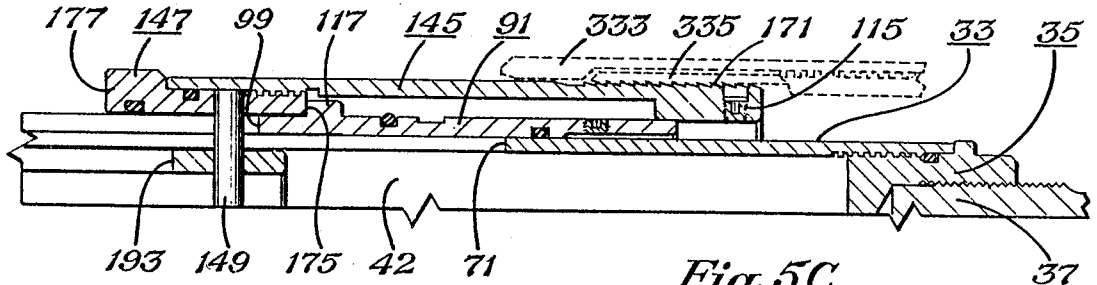

FIGS. 5A, 5B, and 5C are longitudinal cross-sectional views of the bridge plug in a third position for equalizing pressure above and below the bridge plug.

Figure 6A:
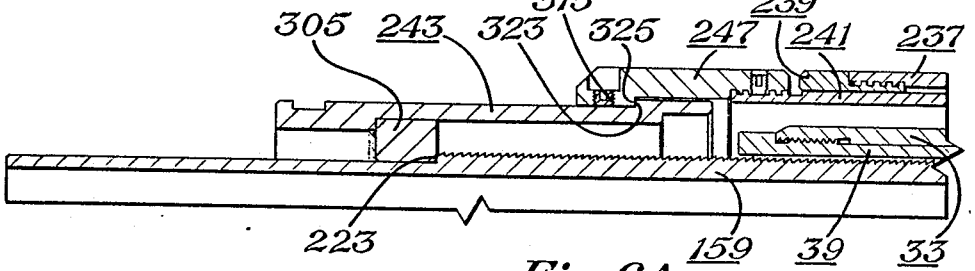
Figure 6B:
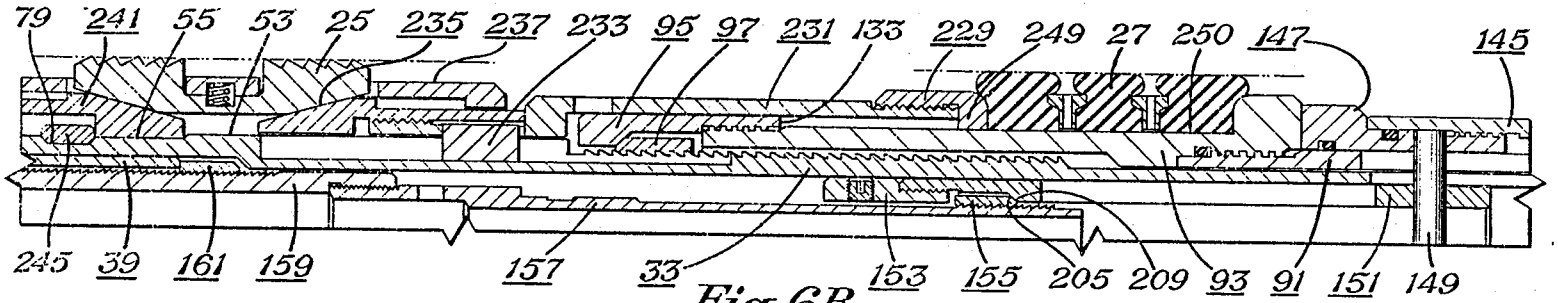
Figure 6C:
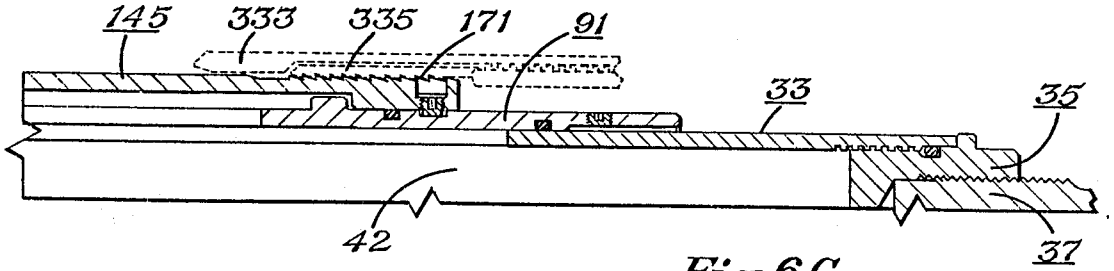

FIGS. 6A, 6B, and 6C are longitudinal cross-sectional views of the bridge plug in a fourth position for uncovering the lock segments.

Figure 7A:
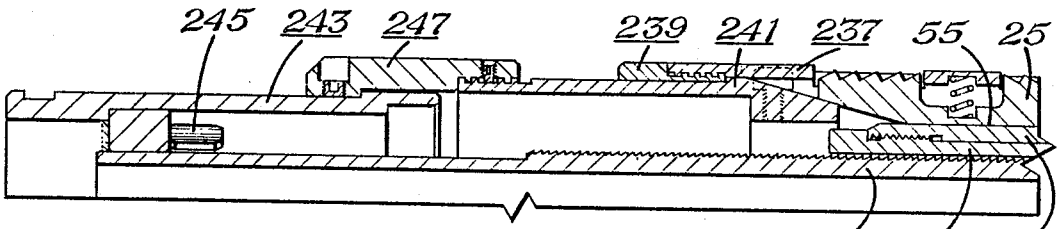
Figure 7B:
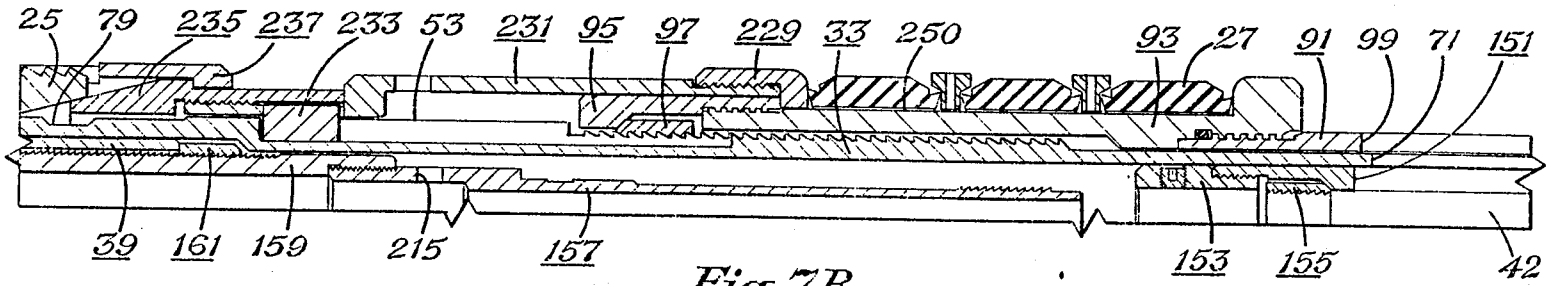
Figure 7C:
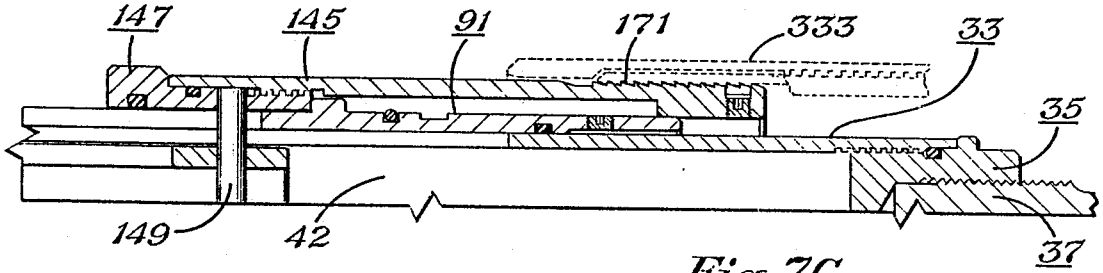

FIGS. 7A, 7B, and 7C are longitudinal cross-sectional views of the bridge plug in a fifth or released position for retrieval.

In FIGS. 3A, 3B, and 3C, the cross-section of the complete bridge plug can be viewed by placing the right and left ends of FIG. 3A and FIG. 3B together respectively and the right and left ends of FIG. 3B and FIG. 3C together respectively. Similarly, in FIGS. 4, 5, 6, and 7, the full length of the bridge plug can be viewed by placing the right and left ends of "A" and "B" figures together respectively and the right and left ends of the "B" and "C" Figures together respectively. FIGS.

4, 5, 6, and 7 are cross-sectional views of one half of the bridge plug from its center line outward.

DESCRIPTION OF THE PREFERRED EMBODIMENT

Figure 1:
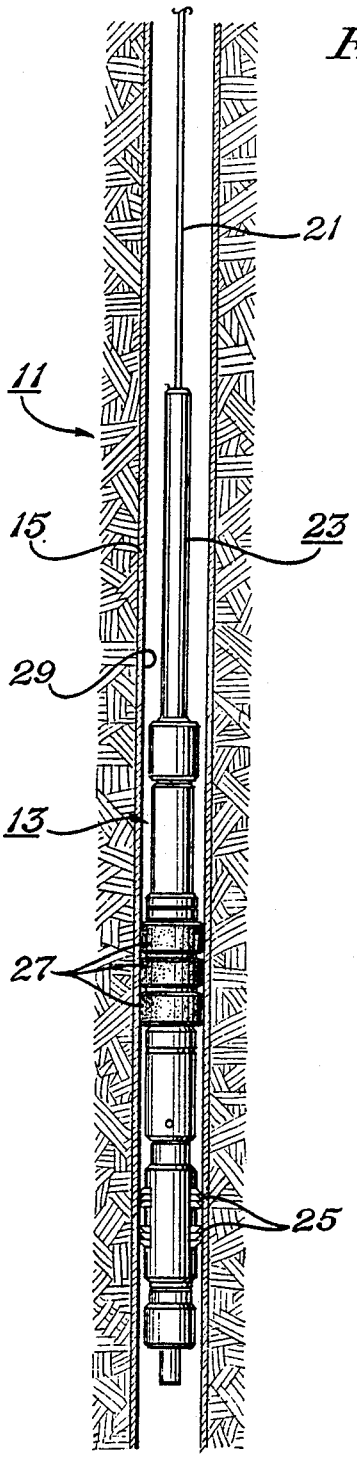
FIG. 1 is a longitudinal cross-sectional view of a cased well borehole, with the retrievable bridge plug of the present invention, in accordance with a preferred embodiment, therein.

In FIG. 1, there is shown a longitudinal cross-sectional view of a well 11 with the retrievable bridge plug apparatus 13 of the present invention, in accordance with a preferred embodiment, therein. The borehole 11 is a typical oil or gas borehole lined with casing 15. The borehole extends through upper and lower production zones (not shown).

In a typical workover situation, where the uppermost zone is to be isolated from the lowermost zone, the bridge plug 13 is lowered by an electric wireline 21 down the well to a point between the zones. The bridge plug is set in position inside of the casing, wherein workover operations can proceed. The bridge plug is retrievable in that once workover operations have been completed on the uppermost zone, the bridge plug can be pulled up out of the well 11.

Figure 2:
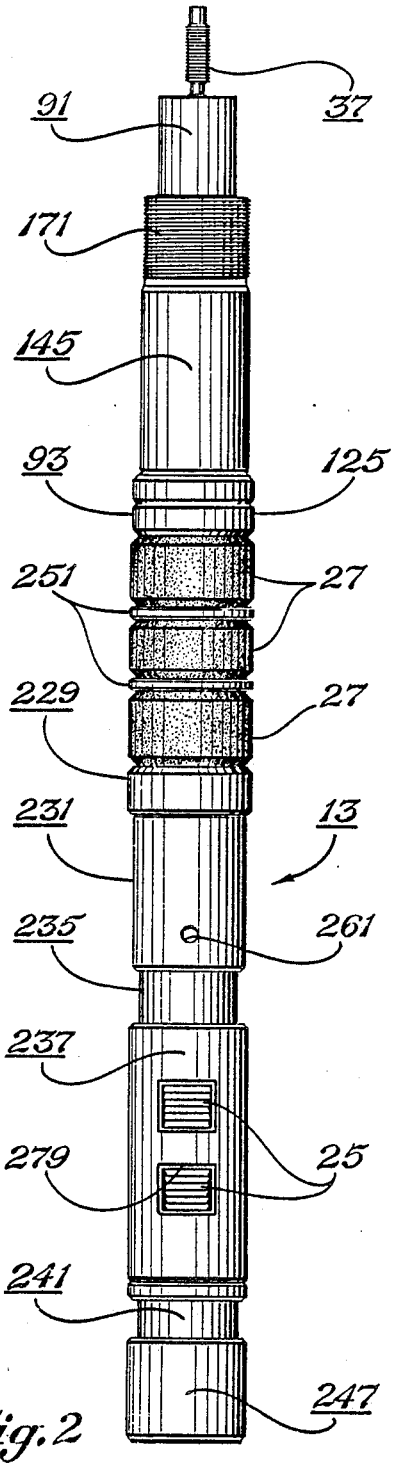
FIG. 2 is a side view of the bridge plug of FIG. 1.

The bridge plug 13 is set so as to form a seal between the upper and lower zones. A conventional setting tool 23 is used to set the bridge plug 13 in position inside of the casing 15. The bridge plug 13 has slip segments 25 and packing elements 27 that extend radially outward to engage the inside surface 29 of the casing 15, when the bridge plug is set (see also FIG. 2). The slip segments 25 grip the casing 15 to prevent longitudinal movement of the bridge plug up or down the well casing. The elastomeric packing elements 27 are compressed to contact the inside surface 29 of the casing to provide a seal between the bridge plug and the casing.

In using and running the bridge plug 13 in and out of the borehole 11, the bridge plug is manipulated through five positions. In the first or running position (see FIGS. 3A–3C), the slip segments 25 and the packing elements 27 are retracted, allowing the bridge plug to be lowered downhole. In the second or set position (see FIGS. 4A–4C), the bridge plug is set and the slip segments 25 and the packing elements 27 are extended to engage the casing 15. In the third position (see FIGS. 5A–5C), the bridge plug is readied for retrieval by opening a valve to equalize pressure above and below the bridge plug. The slip segments 25 and the packing elements 27 remain extended to engage the casing 15. In the fourth position (see FIGS. 6A–6C), locking segments 245 within the bridge plug that prevent the retraction of the slip segments and packing elements are released. The locking segments are released as a prerequisite to retracting the slip segments and packing elements. In the fifth position (see FIGS. 7A–7C), the slip segments and packing elements are retracted, and the valve is re-opened to allow the bridge plug to be pulled up out of the borehole.

In manipulating the bridge plug, upward force is first required to equalize pressure while downward force is next required to release the locking segments 245 in preparation for retracting the slip segments and packing elements. The use of opposite direction manipulations for equalizing pressure and releasing the locking segments prevents the inadvertent release of the bridge plug during pressure equalization.

In the figures showing the bridge plug in its various positions, the lower end portion of the bridge plug is shown in FIGS. 3A, 4A, 5A, 6A, and 7A, the central portion is shown in FIGS. 3B, 4B, 5B, 6B, and 7B, and the upper end portion is shown in FIGS. 3C, 4C, 5C, 6C, and 7C.

The bridge plug 13 includes a main body assembly, a valve body assembly, a valve cover assembly, and a slip assembly. Each assembly includes a plurality of components that move or act together. Referring to FIGS. 2, and 3A–3C, the bridge plug components will be described with the bridge plug in the first position. In describing the components of the bridge plug, the terms "upper" and "lower" will be used, with reference to the orientation of the bridge plug in the well.

The main body assembly includes a main body 33, a top plug 35, a release stud 37, and a lower lock ring retainer 39. The body 33 is tubular having a wall 41 forming an interior cavity 42 extending between upper and lower ends 43, 45. At the upper end 43 of the body 33, the interior cavity 42 is prevented from communicating with the exterior of the body by the top plug 35. However, the body 33 has a pair of longitudinal slots 71 located near the upper end 43. The slots 71 penetrate the wall 41 so that the interior cavity 42 can communicate with the exterior of the body through the slots. The lower end 45 of the body is open so that the lower end of the interior cavity 42 can communicate with the exterior of the body. The interior cavity 42 forms an interior passage through the bridge plug with openings located at the slots 71 and at the lower end 45 of the body 33. The wall 41 has first and second interior surfaces 47, 49 and first, second and third exterior surfaces 51, 53, 55.

The upper end portion 43 of the body has interior stub acme threads 57 to receive exterior threads on the top plug 35. The top plug 35 is screwed into the upper end 43 of the body 33 until a radial flange 59 projecting out from the top plug abuts on the body upper end. A top plug exterior surface 61 extends between the flange 59 and the upper end of the top plug. The top plug 35 has a circumferential groove 63 located between the threads and the flange. The groove 63 receives an elastomeric O-ring 65 that provides a seal between the body 33 and the top plug 35. The top plug 35 has a threaded central bore 67 that opens to the upper end of the top plug. The central bore receives one end of the threaded release stud 37. The release stud 37 has threads along its length, with the exception of a circumferential notch 69 which is located between the ends of the release stud. The notch 69 creates a weakened portion, wherein when sufficient force is applied, the release stud 37 will sever at the notch.

The body 33 has exterior buttress threads 73 which are located between the slots 71 and the body lower end 45. The buttress threads 73, which have inclined surfaces oriented downwardly and outwardly, connect the first exterior surface 51 to the second exterior surface 53. A longitudinal key groove 75 is formed in portions of the second exterior surface 53 and the buttress threads 73. The third exterior surface 55 merges with the second exterior surface 53 by way of a beveled surface 77. The third exterior surface 55 has a smaller outside diameter than the second exterior surface 53. A shallow circumferential groove 79 is formed in the third exterior surface 55. The shallow groove 79 has beveled edges 80. The first interior surface 47 merges with a beveled surface 81, which in turn merges with the second interior surface 49. The lower end 45 of the body 33 has interior threads 83 for receiving the generally cylindrical lower lock ring retainer 39. The lower end of the lower lock ring retainer 39 has a shoulder 85 for abutting against the lower end 45 of the body 33 (see FIG. 3A). A recess 87 (see FIG. 3B) is created by the upper end of the lower lock ring retainer 39, the second interior surface 49 of the body, and the beveled surface 81.

The valve body assembly, which is generally tubular, includes a valve body 91, a packing mandrel 93, a body lock ring back-up 95, and a body lock ring 97. The valve body 91 is positioned at the upper end portion of the body 33 such that the valve body can slide longitudinally along the first exterior surface 51 of the body 33. The valve body 91 has two longitudinal slots 99 that are aligned, for at least a portion of their length, with the body slots 71. The valve body 91 has, located between the slots 99 and the valve body upper end, circumferential grooves 101, 103 for receiving elastomeric O-rings 105, 107. One groove 101 is interiorly located such that the O-ring 105 provides a seal between the valve body 91 and the first exterior surface 51 of the body 33. The other groove 103 is located on the exterior of the valve body and receives the other O-ring 107. Near the upper end of the valve body 91 are threaded openings 109 for receiving respective shear screws 111. The shear screws 111 bear on the exterior surface 61 of the top plug 35 so as to be adjacent to the top plug flange 59. The valve body 91 has bores 113 in its exterior, for receiving the respective end portions of shear screws 115. The valve body has a radial stop flange 117 that projects outwardly, which flange is located between the lohgitudinal slots 99 and the exterior O-ring groove 103. The lower end of the valve body has exterior stub acme threads 119 for receiving the interior threads of the packing mandrel 93.

The upper and lower ends of the packing mandrel have respective flat surfaces 121, 123. A thick flange 125 extends radially outward from the upper end of the packing mandrel 93. The packing mandrel 93 has an interior circumferential groove 127, for receiving an elastomeric O-ring 129. The O-ring 129 provides a seal between the packing mandrel 93 and the valve body 91. The lower end of the packing mandrel 93 has exterior stub acme threads 131 for engaging the interior threads of the body lock ring back-up 95.

The body lock ring back-up 95 has upper and lower ends 133, 135. When the body lock ring back-up 95 is threaded onto the packing mandrel 93, an interior recess 137 is formed by the lower end surface 123 of the packing mandrel, an interior surface of the body lock ring back-up 95 and a beveled surface 139 of the body lock ring back-up. The recess 137 receives the body lock ring 97. The body lock ring 97 has interior buttress threads for engaging the buttress threads 73 on the body 33. The body lock ring 97 has a beveled surface 141 such that the body lock ring can matingly fit within the recess 137. The body lock ring 97 has a small longitudinal gap (not shown) formed therethrough, which allows the body lock ring to change diameter. The body lock ring is in effect a "C-ring". The recess 137 is sized so as to allow the body lock ring 97 to increase its diameter, wherein the buttress threads of the body lock ring and the body buttress threads 73 can disengage and the body lock ring can be moved longitudinally to another location along the body. In the first position, the body lock ring 97 is positioned at the upper end of the body buttress threads 73.

The valve cover assembly includes a fishing neck 145, a valve cover 147, a cross-link pin 149, a top lock ring back-up 151, a top lock ring retainer 153, a top lock ring 155, an upper ratchet body 157, a lower ratchet body 159, and a lower lock ring 161.

The fishing neck 145 and the valve cover 147 are generally tubular and are located along the exterior of the valve body 91. The fishing neck 145 has flat upper and lower ends 163, 165. Threaded openings 167 located near the upper end 163 receive the shear screws 115. The fishing neck 145 has an interior shoulder 169 located near its upper end 163. The interior shoulder 169 is adjacent to the upper shoulder surface of the flange 117, such that when the fishing neck 145 is moved towards the lower end of the bridge plug 13, the interior shoulder 169 will bear on the flange 117 and the shear screws 115 will remain intact. The O-ring 107, which is located in the exterior groove 103 of the valve body 91, provides a seal between the valve body 91 and the fishing neck 145. The fishing neck 145 has exterior buttress threads 171 near its upper end 163. The buttress threads 171 have inclined surfaces that are oriented downwardly and outwardly. The fishing neck 145 has interior stub acme threads 173 located near its lower end 165, which threads engage exterior threads near the upper end 175 of the valve cover 147. The valve cover 147 has at its lower end 177 a thick radial flange 179. The lower end 165 of the fishing neck 145 abuts on the upper shoulder surface of the flange 179. The lower end 177 of the valve cover 147, and consequently the flange 179, abuts against the upper end surface 121 of the packing mandrel 93. The fishing neck 145 and the valve cover 147 can slide along the exterior of the valve body 91. The range of motion of the fishing neck 145 and the valve cover 147, relative to the valve body 91, is limited by the upper end surface 121 of the packing mandrel 93, which is the lowermost limit, and the stop flange 117, which is the uppermost limit. At the uppermost limit, the stop flange 117 contacts the upper end 175 of the valve cover 147. The valve cover 147 has interior and exterior circumferential grooves 181, 183 for receiving respective elastomeric O-rings 185, 187. The interior O-ring 185 provides a seal between the valve body 91 and the valve cover 147. The exterior O-ring 187 provides a seal between the valve cover 147 and the fishing neck 145. The valve cover has diametrically opposed openings 189 for receiving the ends of the cross-link pin 149. The cross-link pin 149 extends through the slots 99 of the valve body 91, the slots 71 of the body 33, and the interior cavity 42 of the body 33.

The top lock ring back-up 151, the top lock ring retainer 153, the top lock ring 155, the upper ratchet body 157, and the lower ratchet body 159 are generally tubular and are located within the interior cavity 42 of the body 33. The top lock ring back-up 151 has an outside diameter that is slightly less than the inside diameter of the body first interior surface 47. The top lock ring back-up 151 has openings 191 near its upper end, which openings receive the cross-link pin 149. The cross-link pin 149 provides a mechanical linkage between the fishing neck 145 and the valve cover 147 on the exterior of the body 33, and the top lock ring back-up 151, the top lock ring retainer 153, the top lock ring 155, the upper ratchet body 157, and the lower ratchet body 159 in the interior of the body 33. The cross-link pin 149 also prevents rotation of the valve cover 147, the valve body 91, the top lock ring back-up 151, the top lock ring retainer 153, and the top lock ring 155 relative to the body 33. The top lock ring back-up 151 has two longitudinal slots 193 which are aligned with the slots 71 in the body 33. The lower end of the top lock ring back-up 151 has interior threads 195 that engage the upper end of the top lock ring retainer 153.

The top lock ring back-up 151 and the top lock ring retainer 153 are positioned on the exterior of the upper ratchet body 157. The top lock ring retainer 153 has threaded openings 197 for receiving shear screws 199. The shear screws are also received by respective bores 201 in the upper ratchet body 157. A recess 203 is formed by the upper end of the top lock ring retainer 153, an interior surface of the top lock ring back-up 151, and a beveled surface 205 of the top lock ring back-up. The recess 203 receives the top lock ring 155. The top lock ring 155 has interior buttress threads 207 oriented downwardly and inwardly. The top lock ring 155 has a beveled surface 209 for engaging the recess beveled surface 205. The top lock ring 155 has a small longitudinal gap (not shown) formed therethrough which allows the top lock ring to change diameters. The top lock ring is in effect a "C-ring". The recess 203 is sized so as to allow the top lock ring 155 to increase its diameter, wherein the buttress threads 207 of the top lock ring can ratchet up with respect to buttress threads 211 on the upper ratchet body 157. In the first position, the top lock ring 155 is positioned at about the middle of the upper ratchet body 157.

The upper ratchet body 157 has, near its upper end, exterior buttress threads 211 for matingly engaging the buttress threads 207 of the top lock ring 155. The upper end of the upper ratchet body 157 is located below the cross-link pin 149. The upper ratchet body 157 has a shoulder 213 which abuts against the lower end of the top lock ring retainer 153. The upper ratchet body 157 has a port or opening 215 formed through its tubular wall, near the lower end of the upper ratchet body. Exterior threads 217 are formed at the lower end of the upper ratchet body 157, which threads engage interior threads on the upper end of the lower ratchet body 159.

The lower ratchet body 159 has an outside diameter that is slightly less than the inside diameter of the body first interior surface 47. Buttress threads 219 are formed on the outside diameter of the lower ratchet body 159. The buttress threads 219 are oriented upwardly and outwardly. The buttress threads 219 extend from near the upper end of the lower ratchet body 159 towards the lower end. The lower ratchet body 159 has at its lower end an exterior surface 221 of reduced outside diameter. The exterior surface 221 extends from the lower ratchet body lower end for about one-quarter of the length of the lower ratchet body, where it merges with a shoulder surface 223, which in turn merges with the buttress threads 219. The lower lock ring 161 is received by the recess 87 formed by the body 33 and the lower lock ring retainer 39. The lower lock ring 161 has interior buttress threads for matingly engaging the buttress threads 219 of the lower ratchet body 159. In the first position, the lower lock ring 161 is positioned near the shoulder surface 223 of the lower ratchet body 159. The lower lock ring 161 has a beveled surface 225 for engaging the recess beveled surface 81. The lower lock ring 161 has a small longitudinal gap (not shown) that allows the lower lock ring to change diameter. The lower lock ring is in effect a "C-ring". The recess 87 is sized so as to allow the lower lock ring 161 to increase its diameter, wherein the buttress threads of the lower lock ring can ratchet up with respect to the buttress threads 219 on the lower ratchet body 159.

The slip assembly is generally tubular and is located around the exterior of the body 33. The slip assembly includes a guide ring 229, a compression sleeve 231, a torque key 233, an upper cone 235, a slip housing 237, slip segments 25, a slip housing nut 239, a lower cone 241, a lock segment cover 243, lock segments 245, and a bottom guide 247.

The guide ring 229 has an inwardly extending flange 249, the inside diameter of which slidingly engages the exterior of the packing mandrel 93. A circumferential channel 250 is formed by the guide ring flange 249, the exterior of the packing mandrel 93, and the packing mandrel flange 125. The channel 250 receives the circumferential packing elements 27. In the preferred embodiment, there is a lower packing element, a central element, and an upper element, which elements are separated by annular rings 251. The lower end of the guide ring 229 has interior threads 253 for receiving exterior threads on the upper end of the compression sleeve 231. The upper end of the compression sleeve 231 and the upper end 133 of the body lock ring back-up 95 abut on the guide ring flange 249.

The compression sleeve 231 has upper and lower portions 255, 257. The upper portion 255, which extends from the upper to the central portion of the compression sleeve 231, is interposed between the guide ring 229 and the body lock ring back-up 95. A cavity 259 is thus formed between the upper end portion 255 and the buttress threads 73 of the body 33, wherein the body lock ring back-up 95 can move relative to the body 33. A port 261 in the upper end portion allows communication between the cavity 259 and the exterior of the bridge plug 13. The lower portion 257 of the compression sleeve 231 has smaller inside and outside diameters relative to the upper portion 255, such that a shoulder surface 263 is formed. The lower portion 257 has an opening 265 for receiving an outer portion of the torque key 233. The inner portion of the torque key 233 is received by the key slot 75 in the body 33. The torque key 233 prevents rotation of the body 33 relative to the compression sleeve 231. If, for example, it became necessary to drill out the bridge plug, the drilling would impart clockwise rotary forces to the bridge plug. Friction between the slip segments 25 and the upper cone 235 would prevent rotation of the upper cone and the compression sleeve 231, while the torque key 233 would prevent rotation of the body 33. The cross-link pin 149 would in turn prevent rotation of the valve body 91 and the valve cover 147. The thread 173 between the valve cover and the fishing neck 145 would prevent the fishing neck from rotating clockwise. The lower portion 257 of the compression sleeve 231 has exterior threads 267 for engaging interior threads in the upper cone 235. The lower end of the compression sleeve 231 contacts a portion of the second exterior surface 53 of the body 33.

The upper cone 235 has a cylindrical portion 269 that overlays the torque key 233 and abuts on the compression sleeve shoulder surface 263. The lower end portion of the upper cone 235 slidingly engages the second exterior surface 53 of the body 33. The lower end portion has an exterior surface 271 that is frusto-conical in shape.

In the preferred embodiment, there are four slip segments 25 which are spaced 90 degrees around the circumference of the bridge plug. The individual slip segments 25 have upper and lower sets of teeth 273, 275 which are connected together by a connecting portion 277. Each slip segment 25 is confined next to the body 33 by the slip housing 237. The slip housing 237 has a set of ports 279 for each slip segment; there being separate ports for the upper and lower sets of teeth. A spring 281 positioned between the slip housing 237 and the connecting portion 277 of each slip segment 25 maintains the respective slip segments 25 in a retracted position, in the absence of any force produced by the upper and lower cones 235, 241, wherein the upper and lower sets of teeth 273, 275 are retracted inside of the slip housing. Each slip segment 25 has upper and lower inclined surfaces 283, 285 for engaging the frusto-conical surfaces 271, 287 of the upper and lower cones 235, 241. The slip segments 25 can be forced outward to a deployed position wherein the upper and lower sets of teeth 273, 275 are exterior of the slip housing 237 by moving the upper and lower cones 235, 241 closer together such that their frusto-conical surfaces 271, 287 engage more fully the respective inclined surfaces 283, 285. The slip housing 237 has interior stub acme threads 289 on its lower end, which engage exterior stub acme threads on the upper end of the slip housing nut 239. Respective shoulder surfaces 291, 293 are formed by an inwardly extending flange at the upper end of the slip housing 237 and by the upper end of the slip housing nut 239, which shoulder surfaces abut on respective exterior shoulder surfaces in the upper and lower cones 235, 241.

The lower cone 241 has an upper end portion and a cylindrical portion 297. The upper end portion slidingly engages the third exterior surface 55 of the body 33. The upper end portion of the lower one 241 is interposed between the slip housing 237 and the body 33. Cap screws 294 are received by respective threaded bores in the upper end portion of the lower cone 241. The heads of the cap screws 294 are received by longitudinal grooves (not shown) in the interior of the slip housing 237. The cap screws prevent rotation of the lower cone 241 relative to the slip housing 237. As described above, the upper end portion has an exterior surface 287 that is frusto-conical in shape, for engaging the lowermost inclined surface 285 of the respective slip segments 25. The upper end portion forms an interior shoulder surface 295. The cylindrical portion 297 of the lower cone 241 is interposed between the slip housing nut 239 and the lock segment cover 243. The lower end has exterior stub acme threads 299 for engaging interior stub acme threads on the bottom guide 247.

The lock segments 245 have beveled edges so as to be matingly received by the shallow groove 79 in the body 33. In the preferred embodiment, there are four lock segments, which when fitted together make up a ring. The lock segments 245 are retained in the groove 79 by the lock segment cover 243 which is interposed between the lock segments and the cylindrical portion of the lower cone 241. The shoulder surface 295 of the upper end portion of the lower cone 241 abuts on the upper surfaces of the lock segments. Thus, the lower cone 241 is prevented from sliding down the body 33 towards the body lower end 45 by the lock segments 245. The lower surfaces of the lock segments 245 abut a first interior shoulder surface 301 of the lock segment cover 243. The lock segment cover has a second interior shoulder surface 303 near its lower end. The second interior shoulder surface 303 receives an annular bushing 305 which is welded to the lock segment cover 243. The bushing 305 is interposed between the lock segment cover second interior shoulder surface 303 and the lower end of the lower lock ring retainer 39.

The bottom guide 247 has two sets of threaded openings 307, 309. One set of openings 307 is located near its upper end and extends through the stub acme threads. The openings 307 receive set screws 311 which bear into respective recesses 313 near the lower end of the lower cone 241. The other set of openings 309 is located near the lower end of the bottom guide 247 and receive shear screws 315. The shear screws 315 bear into respective recesses 317 in the lower end of the slip segment cover 243. The interior surface 319 of the bottom guide 247 is approximately aligned with the interior surface of the lower cone cylindrical portion 297 so that the lock segment cover 243 can easily slide downwardly between the body 33 and the interior surfaces. An interior shoulder surface 323 on the bottom guide 247 acts as a stop by contacting an exterior shoulder surface 325 on the lock segment cover 243 when the lock segment cover has moved downwardly.

The operation of the bridge plug 13 will now be described. The bridge plug 13 is initially configured in the first or running position, with the slip segments 25 and the packing elements 27 retracted. Referring to FIGS. 1 and 3C, the setting tool 23, which is conventional, is connected to the upper end of the bridge plug 13. The lower end of the setting tool has an adapter rod 329 and a setting sleeve 331. The adapter rod 329 threadingly receives the upper end portion of the release stud 37. The setting sleeve 331 contacts the upper end 163 of the fishing neck 145. The setting tool 23 has an explosive charge (not shown) therein for providing the requisite setting force.

The wireline 21 is attached to the upper end of the setting tool 23 and the setting tool and the bridge plug 13 are lowered or run downhole inside of the casing 15 to the desired depth.

Once the bridge plug 13 is positioned at the desired depth, it is manipulated by the conventional setting tool 23 from the first to the second position, wherein the slip segments 25 and the packing elements 27 are extended to engage the inside surface 29 of the casing 15. Referring to FIGS. 3A–4C, the bridge plug is manipulated to the second position as follows: the setting tool 23 is actuated by the wireline 21 so that the explosive charge inside of the setting tool burns, thus generating high pressure gas, which then forces the setting sleeve 331 downward. The body 33, the top plug 35, and the release stud 37 are held stationary relative to the setting sleeve 331 by the adapter rod 329. The setting sleeve 331 forces the fishing neck 145 and the valve cover 147 downwardly. The lower end 177 of the valve cover 147 bears on the flange 125 of the packing mandrel 93. The downward force exerted on the packing mandrel 93 and the valve body 91 causes the shear screws 111 to shear, thereby unlocking the valve body 91 from the body 33 and allowing relative motion between the valve body 91 and the body 33. The fishing neck 145, the valve cover 147, the packing mandrel 93, the valve body 91, the body lock ring back-up 95, and the body lock ring 97 move in unison down the exterior of the body 33. The packing elements 27, which are made of a stiff elastomeric material, transmit the downward force of the packing mandrel flange 125 to the guide ring 229. Thus, the guide ring 229, the compression sleeve 231, the torque key 233, and the upper cone 235 move in unison down the exterior of the body 33. Because the lower cone is prevented from moving downward by the lock segments 245, the upper cone 235 is forced closer to the lower cone 241. The frusto-conical surfaces 271, 287 slidingly engage the upper and lower inclined surfaces 283, 285 of each slip segment 25, forcing the slip segments 25 outwardly. The upper and lower sets of teeth 273, 275 engage the inside surface 29 of the casing 15, wherein the bridge plug 13 becomes locked in place inside of the casing 15.

At some point, the upper cone 235, the compression sleeve 231, and the guide ring 229, become stationary, being unable to force the slip segments out any further. However, the setting sleeve 331 continues to provide downward force, wherein the downward movement (relative to the body 33) of the fishing neck 145, the valve cover 147, the packing mandrel 93, the valve body 91, the body lock ring back-up 95, and the body lock ring 97 continues. The packing mandrel flange 125 is forced closer to the guide ring flange 249, shortening the width of the channel 250 and compressing the packing elements 27. The compressed packing elements are forced outwardly to engage the inside surface 29 of the casing 15. The body lock ring 97 moves or ratchets from the upper end of the buttress threads 73 on the body 33 towards the lower end of the buttress threads. When the packing elements are fully packed off, the body lock ring 97 reaches its lowermost point of travel along the body buttress threads 73.

As the fishing neck 145 and the valve cover 147 are forced downwardly by the setting sleeve 331, the cross-link pin 149 moves the top lock ring back-up 151, the top lock ring retainer 153, the top lock ring 155, the upper ratchet body 157, and the lower ratchet body 159 downwardly inside of the interior cavity 42 of the body 33. The lower ratchet body 159 ratchets down relative to the lower lock ring 161, wherein the lower lock ring becomes positioned on the central portion of the lower ratchet body.

The explosive charge in the setting tool 23 generates enough force to deploy the slip segments 25 and the packing elements 27 and to sever the release stud 37 at the notch 69. After the slip segments 25 and the packing elements 27 have been extended, the setting sleeve 331 continues to push down on the fishing neck 145 until the fishing neck 145 is immobilized. The setting tool 23 then pulls against the adapter rod 329 and the release stud 37. The notch 69 forms a weakened portion which insures that the release stud will break at that point. Upon severance of the release stud at the notch, the setting tool 23 is freed of any connection to the bridge plug 13 and can be retrieved from the well.

When the downward force of the setting sleeve 331 and the upward force of the adapter rod are terminated, the packing elements 27 are prevented from expanding and pushing the packing mandrel 93 back up relative to the body 33 by the body lock ring 97. Any upward force on the body lock ring 97 is transmitted by way of the beveled surface 139, which contacts the beveled surface 141 of the body lock ring and forces the body lock ring to firmly engage the buttress threads 73 of the body. Thus, the body lock ring 97 can ratchet down the buttress threads 73, but is prevented from moving up the same buttress threads. Slip segments 25 prevent the upper cone 235, compression sleeve 231 and guide ring 229 from moving downward and the body lock ring 97 prevents upward movement of the body lock ring back-up 95, the packing mandrel 93, and the valve body 91, thereby retaining the packing elements 27 in their packed off condition.

With the bridge plug 13 in the second or set position as shown in FIGS. 4A–4C, the bridge plug seals off the well interval below the bridge plug from the well interval above the bridge plug. The packing elements 27 provide a seal between the inside surface 29 of the casing 15 and the bridge plug 13. The O-rings 65, 105, 107, 129, 185, 187 provide internal seals between the various components of the bridge plug. Thus, the bridge plug provides a seal inside of the casing and workover operations can begin. The slip segments 25 maintain the bridge plug 13 in place at the desired depth, even when the bridge plug is subjected to pressure differentials. Pressure differentials cause the slip segments to adjust accordingly. For example, high pressure above the bridge plug will be transmitted to the slip segments by way of the upper cone 235, which produces more force on the upper sets of teeth 273 of the slip segments 25, thereby further setting the slip segments into the casing 15.

After workover operations on the formations have been completed, the bridge plug can be retrieved from the well. To retrieve the bridge plug, a conventional retrieving tool 333 is lowered downhole on a wireline or tubing string. Referring to FIG. 5C, the lower end portion of the retrieving tool 333 is generally tubular and has an interior recess. The recess receives an annular grapple 335, which has interior buttress threads for matingly engaging buttress threads 171 on the fishing neck 145. The grapple 335 can expand radially for ratcheting down on the fishing neck 145. The retrieving tool is lowered until good contact has been established with the bridge plug, wherein the buttress threads are matingly engaged.

The bridge plug is manipulated from the second position to the third position in order to equalize pressure between the upper and lower portions of the well. Referring to FIGS. 4A–5C, pressure is equalized by opening the valve formed by the fishing neck 145 and the valve cover 147, which blocks the flow path formed by the valve body slot 99, the body slot 71, the top lock ring back-up slot 193, and the interior cavities of the upper and lower ratchet bodies 157, 159, which are located in the interior cavity 42 of the body 33. The wireline is pulled up to pull up on the retrieving tool 333 and the fishing neck 145. The shear screws 115 between the fishing neck 145 and the valve body 91 shear because the valve body 91, the packing mandrel 93, and the body lock ring back-up 95 are prevented from moving upwardly by the body lock ring 97. In addition, the shear screws 199 between the top lock ring retainer 153 and the upper ratchet body 157 shear because the lower ratchet body 159 and the upper ratchet body 157 are prevented from moving upwardly by the lower lock ring 161. The beveled surface 81 of the body 33 contacts the beveled surface 225 of the lower lock ring 161 and causes the lower lock ring to firmly engage the buttress threads 219 of the lower ratchet body 159. Thus, the fishing neck 145, the valve cover 147, the cross-link pin 149, the top lock ring back-up 151, the top lock ring retainer 153, and the top lock ring 155 move in unison relative to the body 33, the valve body 91, the packing mandrel 93, and the upper ratchet body 157. The upward movement of the fishing neck 145 and the valve cover 147, in particular, opens the flow path (see FIGS. 5B–5C) through the interior of the bridge plug so as to bypass the packing elements 27. The flow path is formed by the gap between the lower end 177 of the valve cover 147 and the upper end 121 of the packing mandrel 93, the valve body slot 99, the body slot 71, the top lock ring back-up slot 193, and the interior cavities of the upper and lower ratchet bodies 157, 159. Thus, fluid can flow through the bridge plug to equalize pressure.

The upward movement of the fishing neck 145 and the valve cover 147 are limited by the stop flange 117 on the valve body 91, wherein the upper end 175 of the valve cover 147 contacts the flange 117. In the preferred embodiment, the fishing neck 145 and the valve cover 147 move up four inches. Any additional upward force exerted on the fishing neck 145 and the valve cover 147 by the wireline is transmitted to the lower cone 241 by way of the valve body 91, the packing mandrel 93, the body lock ring back-up 95, the body lock ring 97, the body 33, and the lock segments 245, wherein the lower cone 241 further sets the slip segments 25 into the casing 15. Thus, control of the bridge plug is maintained while pressure is being equalized.

As mentioned hereinabove, the upward movement of the fishing neck 145 results in the upward movement of the top lock ring back-up 151, the top lock ring retainer 153, and the top lock ring 155 relative to the body 33 and the upper ratchet body 157. The top lock ring 155 is pushed up by the upper end of the top lock ring retainer 153 so as to ratchet onto the buttress threads 211 at the upper end of the upper ratchet body 157.

After the pressure has been equalized, the bridge plug is manipulated from the third position to the fourth position, to allow the slip segments 25 and the packing elements 27 to be unlocked for retraction. Referring to FIGS. 5A–6C, the retrieving tool 333 is lowered or set down (with some type of weight such as a sinker bar (not shown) coupled to the upper end of the retrieving tool) by way of the wireline so as to lower the fishing neck 145, the valve cover 147, the cross-link pin 149, the top lock ring back-up 151, the top lock ring retainer 153, and the top lock ring 155 relative to the body 33. The upper ratchet body 157 and the lower ratchet body 159 are pushed down in unison with the fishing neck 145 because the beveled surface 205 of the top lock ring back-up 151 contacts the beveled surface 209 of the top lock ring 155, causing the top lock ring to firmly engage the buttress threads 211 on the upper ratchet body 157. As the upper ratchet body 157 and the lower ratchet body 159 move down, the lower lock ring 161 ratchets up on the buttress threads 219 of the lower ratchet body to a position near the upper end of the lower ratchet body. In addition, as the lower ratchet body 159 moves down, the shoulder surface 223 of the lower ratchet body contacts the bushing 305, providing downward force on the bushing and the lock segment cover 243. This downward force shears the shear screws 315 between the lock segment cover 243 and the bottom guide 247, wherein the bushing and the lock segment cover move down relative to the body 33, the bottom guide 247, and the lower cone 241. The lock segment cover 243 moves down until its shoulder surface 325 contacts the shoulder surface 323 of the bottom guide 247. With the lock segment cover 243 moving down, the lock segments 245 become uncovered and unrestrained. The lock segments 245 are free to fall out and down to the bushing 305 (see FIG. 7A).

The slip segments remain extended because the upper cone is force downwardly and underneath the slip segments by the packing elements. The packing elements, which resist the compressive forces of the shoulders 125, 249, push down on the guide ring 229 and the compression sleeve 231. Thus, even if the lower cone were to fall away from the slip segments, the slip segments would remain extended until the bridge plug is pulled up again into the fifth position. The lower cone typically remains underneath the slip segments due to friction.

To recover the bridge plug 13, the bridge plug is manipulated from the fourth to the fifth position. Referring to FIGS. 6A–7C, the fishing neck 145 is pulled upwardly with the retrieving tool 333. The valve cover 147 bears on the stop flange 117, wherein the upward force is transmitted to the body 33 by way of the valve body 91, the packing mandrel 93, the body lock ring back-up 95, and the body lock ring 97. The body moves upwardly relative to the upper and lower cones 235, 241, which slide along the second and third exterior surfaces 53, 55. The lower cone 241 is no longer constrained to move upwardly with the body 33 because the lock segments 245 are no longer in the groove 79. The packing mandrel 93 moves up relative to the guide ring 229, which expands the channel 250 thereby removing the longitudinal compressive forces from the packing elements 27 and allowing the packing elements 27 to retract from the casing. Just as the packing elements retract, the upper end 133 of the body lock ring back-up 95 bears on the flange 249 of the guide ring 229. The upward movement of the body 33 is then transmitted to the upper cone 235 through the body lock ring 97, the body lock ring back-up 95, the guide ring 229 and the compression sleeve 231, wherein the upper cone moves upwardly relative to the slip segments. With the upward motion of the upper cone 235, the upper and lower cones separate and the slip segments 25 are retracted by the springs 281.

The cross-link pin 149, the top lock ring back-up 151, the top lock ring retainer 153, and the top lock ring 155 move up in unison with the fishing neck 145 and the valve cover 147. The upward movement of the fishing neck 145, the valve cover 147, and the top lock ring back-up 151 reopens the valve and allow fluids to enter the interior cavity 42 of the body as the bridge plug 13 is pulled up the hole. Fluid enters the gap between the packing mandrel 93 and the valve cover 147, and flows through the valve body slot 99, the body slot 71, and the top lock ring back-up slot 193 into the interior cavity 42 of the body 33. The fluid then flows down through the upper ratchet body 157 and the lower ratchet body 159 where it exits the bridge plug by way of the lower end of the lower ratchet body. The fluid can take an alternative pathway through the annulus between the upper ratchet body 157 and the body 33. The fluid enters the annulus at the upper end of the upper ratchet body and exits through the port 215 in the upper ratchet body. With the packing elements retracted, fluid also flows through the annulus between the bridge plug and the casing.

During workover operations, it is common to drop sand down the well to provide about a ten foot column or bed of sand on top of the bridge plug. This sand protects the bridge plug from foreign material. The bed of sand simplifies retrieval of the foreign material; it is easier to retrieve objects off the top of a bed of sand than off the top of a tool where the foreign material may become lodged. Well fluids are circulated inside of the casing to remove the sand from the bridge plug. Circulation to remove the sand will not cause the valve to open, wherein pressure will equalize, nor will the slip segments or packing elements retract to release the bridge plug from the well casing.

The packing elements 27 are extended after the slip segments 25 are extended, and are retracted before the slip segments are retracted during the respective bridge plug manipulations to set and retrieve the tool. This sequence of extensions and retractions minimizes abrasion of the packing elements against the inside surface of the casing, which abrasion is caused by moving the packing elements longitudinally during set and retrieve operations.

As described hereinabove, the bridge plug apparatus of the present invention can be retrieved with a wireline, thus eliminating the need for a rig and tubing string to retrieve the tool.

Alternative locking means can be used in place of the lock segments 245. For example, a ring having a longitudinal slot for allowing a change in diameter (a C-ring) could also be used. The annulus formed by the lower cone 241 and the body 33 is sized to allow the ring to expand and exit the groove 79, when the lock segment cover 243 is dropped down.

The foregoing disclosure and the showings made in the drawings are merely illustrative of the principles of this invention and are not to be interpreted in a limiting sense.

I claim:

1. A retrievable bridge plug apparatus for use in a well conduit, comprising:

(a) body means having first and second ends and an interior passage formed in said body means, said body means having first and second openings that allow communication between said interior passage and the exterior of said apparatus, said body means first end being adapted to receive setting means for setting said apparatus in said well conduit;

(b) gripping means for engaging and gripping said well conduit, said gripping means being disposed around said body means, said gripping means being extendable from a retracted position to an extended set position wherein said gripping means can engage said well conduit;

(c) first and second extending means for extending said gripping means, said first and second extending means being slidably disposed on said body means, said second extending means being located between said first extending means and said body means second end, said second extending means being prevented from moving toward said body means second end by a first locking means, said first locking means being retained in position relative to said body means by retaining means;

(d) packing means for engaging and providing a seal against said well conduit, said packing means being disposed around said body means and located between said first and second openings, said packing means being extendable from a retracted position to an extended set position wherein said packing means can engage said well conduit;

(e) first shoulder means located on one end of said packing means and second shoulder means located on the other end of said packing means, said first and second shoulder means being slidably disposed on said body means so as to move independently of each other, said second shoulder means being coupled to said first extending means;

(f) cover means for sealingly covering said first opening, said cover means being slidably disposed on said body means;

(g) said gripping means and said packing means being extended by moving said first shoulder means toward said body means second end such that said second shoulder means moves said first extending means closer to said second extending means and said first shoulder means moves closer to said second shoulder means;

(h) said first shoulder means being prevented from moving toward said body means first end by second locking means which is located between said first shoulder means and said body means;

(i) said cover means being movable toward said body means first end to uncover said first opening, wherein pressure can be equalized, said cover means then being movable toward said body means second end;

(j) tubular means located in said body means and being responsive to movement of said cover means toward said second end so as to engage said retaining means, wherein said retaining means is removed from said first locking means and said first locking means is released and said second extending means can move toward said body means second end;

(k) said cover means being movable back toward said body means first end, wherein said cover means moves said body means in the same direction as said cover means causing said first shoulder means, said second shoulder means, and said first extending means to move away from said second extending means allowing said packing means and said gripping means to retract.

2. A retrievable bridge plug apparatus for use in a well conduit comprising:

elongated body means having first and second ends with a first opening at said first end and a second opening at said second end and a passageway extending through said elongated body means between said first and second openings;

first and second interior means located in said passageway with said second interior means located closer to said second end of said body means than said first interior means;

means for allowing said second interior means to move toward said second end of said body means but preventing said second interior means from moving toward said first end of said body means;

locking means for causing said first and second interior means to move together toward said second end of said body means and for allowing said first interior means to move toward said first end of said body means relative to said second interior means;

valve cover means coupled to said first end of said body means and supported for movement in opposite directions toward said first and second ends of said body means for opening and closing said first opening respectively;

means for coupling said first interior means to said valve cover means;

gripping means disposed around said body means between said first and second ends and being extendable from a retracted position outward to an extended set position for engaging the well conduit;

first and second expanding means located at opposite ends of said gripping means for extending said gripping means outward;

said first expanding means being located closer to said first end of said body means than said second expanding means and being movable toward and away from said gripping means;

releasable holding means for normally holding said second expanding means in a given position relative to said body means;

packing mandrel means slidably located around said body means between said gripping means and said first opening of said body means;

expandable packing means carried by said packing mandrel means;

means for allowing said packing mandrel means to move toward said second end of said body means but preventing said packing mandrel means from moving toward said first end of said body means;

compression means for transmitting force applied to said packing means, in the direction of said second end of said body means, to said first expanding means;

whereby said bridge plug apparatus may be set in the well conduit, with said second end of said body means located below said first end of said body means, and said packing means expanded outward to form a seal between said bridge plug apparatus and the inside wall of the well conduit by applying a force to said valve cover means relative to said body means to move said valve cover means, said packing mandrel means, said compression means by way of said packing means, and said first expanding means toward said gripping means to extend said gripping means outward to engage the inside wall of the well conduit and then to expand said packing means outward to engage and form a seal between the inside wall of the well conduit and said bridge plug apparatus;

said bridge plug apparatus may be retrievable from the well conduit by:

moving said valve cover means toward said first end of said body means to open said first opening of said body means to equalize the pressure above and below said body means and to cause said locking means to lock said first interior means to said second interior means;

moving said valve cover means toward said second end of said body means to move said first and second interior means toward said second end of said body means for releasing said holding means;

moving said body means, said packing mandrel means and said first expanding means upward to release said packing means and said gripping means.

3. A retrievable bridge plug apparatus for use in a well conduit, comprising:

main tubular means having an upper end and a lower end with an upper opening at said upper end and a lower opening at said lower end and a passageway extending through said main tubular means between said upper opening and said lower opening;

upper and lower interior tubular means located in said main tubular means with the lower end of said upper interior tubular means located adjacent to the upper end of said lower interior tubular means;

interior coupling means releasably coupling said upper and lower interior tubular means together;

upper locking ring means located between said upper and lower interior tubular means, said interior coupling means and said upper locking ring means providing for said upper and lower interior tubular means to move downwardly in unison relative to said main tubular means while allowing said upper interior tubular means to move upwardly relative to said lower interior tubular means and said main tubular means when said interior coupling means is released;

lower locking ring means located between said main tubular means and said lower interior tubular means, said lower locking ring means allowing for downward movement of said lower interior tubular means relative to said main tubular means but prohibiting upward movement of said lower interior means relative to said main tubular means;

valve body means slidably located around said upper end of said main tubular means;

said valve body means having a valve opening;

valve body coupling means releasably coupling said valve body means to said upper end of said main tubular means wherein said valve opening of said valve body means is in alignment with said upper opening of said main tubular means;

packing mandrel means coupled to the lower end of said valve body means;

valve cover means slidably located around said valve body means and coupled to said upper interior tubular means;

valve cover coupling means releasably coupling said valve cover means to said valve body means wherein said valve cover means is located around said valve opening of said valve body means;

body locking ring means located between said main tubular means and said packing mandrel means, said body locking ring means allowing for downward movement of said packing mandrel means relative to said main tubular means but prohibiting upward movement at said packing mandrel means relative to said main tubular means;

compression sleeve means having an upper end located around the lower end of said packing mandrel means;

expandable packing means located around said packing mandrel means above said compression sleeve means;

grip segment means located around said main tubular means below said compression sleeve means, said grip segment means having upper and lower ends;

grip housing means located around said main tubular means and having opening means in alignment with said grip segment means whereby said grip segment means may be expanded outward through said opening means of said grip housing means;

upper and lower expanding means located at the upper and lower ends respectively of said grip segment means;

releasable lock segment means located to engage said lower expanding means;

lock segment cover means located to normally hold said lock segment means in place against said lower expanding means to hold said lower expanding means in a given position relative to said main tubular means;

lower coupling means for releasably securing said lower expanding means and said lock segment cover means together;

said lock segment cover means having shoulder means for cooperating with said lower interior tubular means when said lower interior tubular means is moved down for retrieving said bridge plug apparatus such that said lock segment cover means is moved to release said lock segment means;

whereby said retrievable bridge plug apparatus may be lowered into a well conduit and secured therein by applying downward force to said valve body means relative to said main tubular means to release said valve body coupling means to move said valve body means and said valve cover means downward to apply downward force to said upper expanding means by way of said packing means to cause said grip segment means to move outward to grip the well conduit and then to compress said packing means outward to form a seal between the exterior of said retrievable bridge plug apparatus and the inside wall of the well conduit;

said retrievable bridge plug apparatus being retrievable from the well conduit by:

applying upward force to said valve cover means relative to said valve body means and said main tubular means to release said valve cover coupling means and said interior coupling means to move said valve cover means upward relative to said valve body means and said main tubular means and to move said upper interior tubular means upwardly relative to said lower interior tubular means and to open said valve opening of said valve body means and said upper opening of said main tubular means to equalize pressure;

applying downward force to said valve cover means relative to said valve body means and said main tubular means to move said upper interior tubular means downwardly, said upper locking ring means causing said lower interior tubular means to move downwardly and engage said shoulder means of said lock segment cover means to release said lower coupling means and to move said lock segment cover means downwardly and release said lock segment means;

applying upward force to said valve cover means relative to said grip segment means, pulling said packing mandrel means upwardly to release said packing means and pulling said upward expanding means upwardly to release said grip segment means.

* * * * *